US008711897B2

(12) United States Patent
Miles

(10) Patent No.: US 8,711,897 B2
(45) Date of Patent: Apr. 29, 2014

(54) SPLIT-RING RESONATOR CREATING A PHOTONIC METAMATERIAL

(75) Inventor: Patrick Allen Miles, Grand Rapids, MI (US)

(73) Assignee: Miles Technologies, LLC, Grand Rapids, MI (US)

( * ) Notice: Subject to any disclaimer, the term of this patent is extended or adjusted under 35 U.S.C. 154(b) by 203 days.

(21) Appl. No.: 13/377,724

(22) PCT Filed: Mar. 15, 2011

(86) PCT No.: PCT/US2011/028432

§ 371 (c)(1),
(2), (4) Date: Dec. 12, 2011

(87) PCT Pub. No.: WO2012/021176

PCT Pub. Date: Feb. 16, 2012

(65) Prior Publication Data

US 2012/0236895 A1 Sep. 20, 2012

(51) Int. Cl.
*H01P 1/20* (2006.01)

(52) U.S. Cl.
USPC ..... 372/109; 333/204; 333/219; 343/732; 343/866; 343/867; 343/909; 343/700 MS; 438/422; 438/455; 438/456

(58) Field of Classification Search
USPC ..... 333/204, 219; 343/732, 866, 867, 909, 343/753; 438/422, 455, 456; 372/109
See application file for complete search history.

(56) References Cited

U.S. PATENT DOCUMENTS

| | | | | |
|---|---|---|---|---|
| 6,822,626 | B2 * | 11/2004 | George et al. | 345/60 |
| 2001/0038325 | A1 * | 11/2001 | Smith et al. | 333/202 |
| 2004/0151876 | A1 | 8/2004 | Tanielian | |

FOREIGN PATENT DOCUMENTS

| | | |
|---|---|---|
| JP | 2007-306563 | 11/2007 |
| KR | 10-2007-0013250 | 1/2007 |
| KR | 10-2009-0108980 | 10/2009 |

OTHER PUBLICATIONS

Sakai et al."Characteristics of metamaterials composed of microplasma arrays," 2007, Plasma Phys. Control. Fusion, 49, p. B453-B467.*
International Search Report dated Oct. 12, 2011.

* cited by examiner

*Primary Examiner* — Xinning Niu
*Assistant Examiner* — Michael Carter
(74) *Attorney, Agent, or Firm* — Dickinson Wright PLLC

(57) ABSTRACT

A split ring-resonator includes a substrate, an inner-trench or cavity formed into the substrate, the inner trench or cavity including a split, and an outer trench or cavity formed into the substrate around the inner trench or cavity, the outer trench or cavity including another split disposed at an opposite end of the split in the inner trench or cavity, wherein the inner trench or cavity and the outer trench or cavity are configured to receive an electrically conductive gas and/or plasma to form a split-ring resonator.

20 Claims, 7 Drawing Sheets

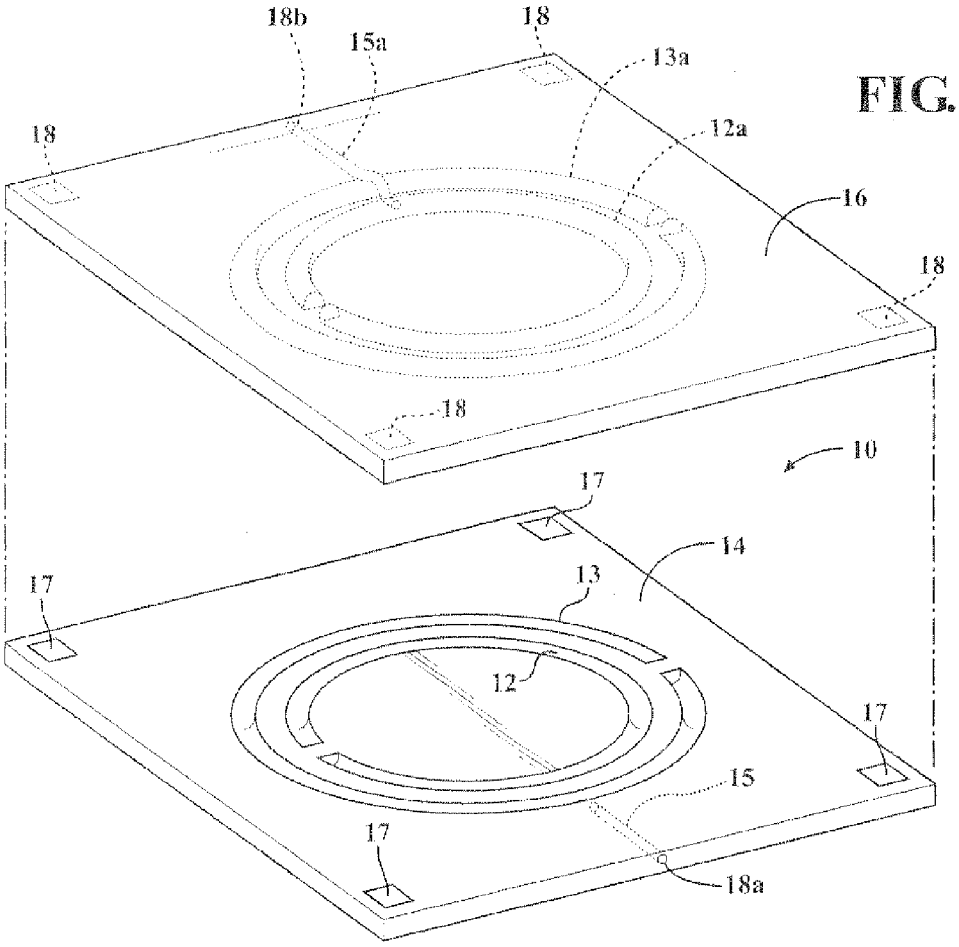
FIG. 3
FIG. 4
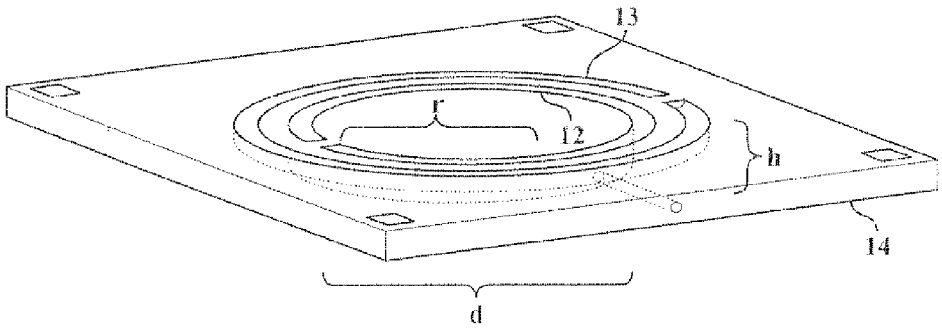

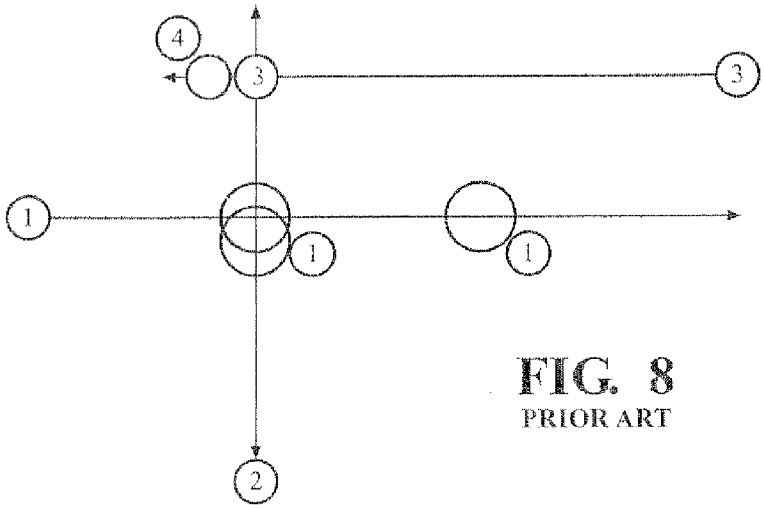
FIG. 8
PRIOR ART
FIG. 9
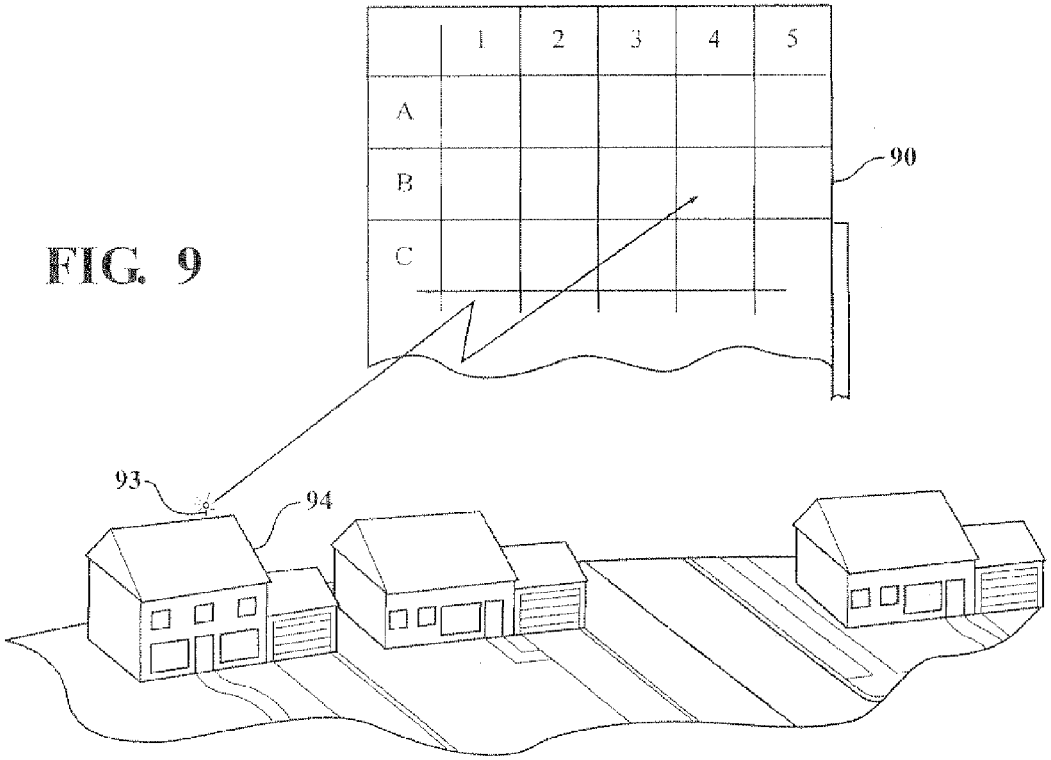

SPLIT-RING RESONATOR CREATING A PHOTONIC METAMATERIAL

CROSS-REFERENCE TO RELATED APPLICATIONS

This application is a national stage of PCT/US2011/028432, filed on Mar. 15, 2011, which is based on U.S. provisional application no. 61/732,689, filed Aug. 11, 2010, the entire contents of which are incorporated herein by references.

FIELD OF THE INVENTION

Aspects of the present invention relate to a split-ring resonator which employs an ionized or charged gas, beam, or plasma or any similar type of a particle-level conductor, and more particularly, to a split-ring resonator which employs an ionized or charged gas, beam, or plasma or any similar type of a particle-level conductor to create a photonic metamaterial interacting with or operating at optical frequencies, such as terahertz (THz), infrared, or visible light.

BACKGROUND OF THE INVENTION

Recently, materials known as "metamaterials" have been discovered. Metamaterials include a type of artificial structure, referred to as a "left-handed medium" (LHM), which is characterized by having a negative refractive index. Generally, metamaterials are periodic structures composed of artificially constructed structural units, or "cells," whose dimensions are smaller than the radiation that is being controlled, but are far larger than atomic or molecular scales. The metamaterial interacts with radiation as if it is a homogenous material with an effective electric permittivity and magnetic permeability. The goal is to design the sub-wavelength structures (i.e., the cells) to achieve properties and effects that do not arise from known natural materials, whose unit cells are atoms or molecules.

Simply put, a LHM affects electromagnetic waves by having structural features smaller than the wavelength of the electromagnetic radiation it interacts with. For example, if microwave radiation (with wavelength $\lambda$ approximately 1 m to 1 mm) is used, the LHM needs to have a structure smaller than 1 mm. Microwave frequency metamaterials are constructed as arrays of electrically conductive and non-magnetic metal elements (such as loops of copper wire) which have suitable inductive and capacitive characteristics. In particular, these structures are designed to have strong coupling to magnetic fields at microwave frequencies with low losses. Such is not a characteristic of ordinary materials. For example, ordinary non-magnetic materials have extremely weak coupling to magnetic fields, and ferromagnetic materials have strong coupling but large losses. The most common type of metamaterials for microwave radiation are based on split-ring resonators.

FIG. 1 depicts a conventional split-ring resonator 1 according to the related art. The conventional split-ring resonator 1 has been shown to be effective at achieving a negative refractive index for tower-frequency radiation, such as microwaves. As shown in FIG. 1, the conventional split-ring resonator 1 is typically formed as a pair of concentric annular rings 2 and 3 with splits in them at opposite ends. The pair of concentric annular rings includes an inner ring 2, and an outer ring 3 wrapped around the inner ring 2, with the rings having gaps between them and having splits formed approximately 180 degrees apart from each other. Conventionally, the rings are made of an electrically conductive and nonmagnetic metal, such as copper.

The split-ring resonator is typically disposed in a substrate 4. The substrate 4 is usually a circuit board, or may be formed out of fiberglass or some other material. The substrate 4 typically supports a periodic, or repeating, array of conventional split-ring resonators 1 formed in parallel with each other and connected to each other by conductive wire strips 5.

A magnetic flux penetrating the metal rings 2 and 3 will induce current in the rings 2 and 3, which in turn produces a magnetic flux that can either enhance or oppose the incident field, depending on the resonant properties of the split-ring resonator and the frequency of the radiation 1. Due to splits in the rings 2 and 3, the structure can support resonant wavelengths much larger than the diameter of the rings. The small gaps between the rings produce large capacitance values which lower the resonance frequency. At frequencies below the resonant frequency, the real part of the magnetic permeability of the split-ring resonator becomes large and is positive, and at frequencies higher than resonance it becomes negative. The negative permeability response can be used with the negative dielectric constant of another structure to produce a "left-handed material" with negative refractive index. Left-handed materials can have very interesting and potentially very useful properties not found in naturally occurring materials.

The type of radiation which the conventional split-ring resonator 1 will effectively work with is limited by the dimensions of the split-ring resonator 1. The diameter of the conventional split-ring structure 1 must be very small compared to the resonant wavelength in order to achieve a negative refractive index. Microwaves typically have wavelengths ranging from 1 in to 1 mm, and corresponding frequencies ranging from 300 MHz (0.3 GHz) to 300 GHz. Accordingly, to effectively work with microwaves, the conventional split-ring resonator 1 has been designed to have a diameter of less than 1 mm. Continuing research is underway to design split-ring resonators with increasingly smaller diameters that will function with increasingly higher frequency and lower wavelength radiation, and split-ring resonators with diameters as small as a few dozen μm have been achieved.

However, a problem with all of the conventional split-ring resonators in the related art is that these conventional split-ring resonators employ copper or some other metallic wire to form the split rings. Metal wire is increasingly difficult to manipulate as the diameter or size decreases, and this presents a serious technical obstacle for creating split-ring resonators which will achieve a negative refractive index for higher frequency radiation, such as visible light, which has a wavelength range of about 380 nm-780 nm and a corresponding frequency ranging from about 430 trillion Hz (430 THz) to about 750 trillion Hz (750 THz). For a split-ring resonator to achieve a negative refractive index for optical frequencies, including visible light, a conventional split-ring resonator must have an inner radii of no greater than 30 to 40 nm, and preferably much less. In the related art, it has so far been impossible to design a split-ring resonator having the required inner radii to function at optical frequencies using conventional structures, such as copper split-rings. As a result, it has also been impossible to achieve the numerous potential benefits that would result from being able to manipulate higher frequency radiation with a negative index of refraction material, such as sub-wavelength resolution optics, optical cloaking, ultra-high efficiency detection, and likely applications for more powerful communications and computing.

Additional problems occur using metallic split-ring resonators. For example, naturally paramagnetic and ferromagnetic materials only achieve strong coupling to magnetic fields that have significant losses. Moreover, resonance for electric and magnetic response does not occur over the same frequency and for natural materials, whose response to electromagnetic fields is governed by individual atomic or molecular properties, there is no obvious way to change this.

The desirability of interacting with or operating at optical frequencies is well-established. For example, stronger magnetic coupling occurs which can achieve negative index of refraction in the optical range leading to super-lenses (subwavelength imaging) and potentially assisting the development of transformation optics through the complete control over light. Structures with strong magnetic coupling and low losses at optical frequencies, even without negative index of refraction behavior, would also be important in this regard.

Some scaling down of structures to produce metamaterials for optical frequencies using nano-scale fabrication has occurred. One approach has been to create very small metallic rods which are physically connected and fabricated using electron beam and nanolithography techniques.

Moving from a metallic split-ring resonator to non-metallic, photonic split-ring resonators is analogous to the progression of the technology associated with communications evolving from land-line based communications transmitted through copper wire, to radio signals transmitted through the air, to fiber optic light pulses transmitted through fiber optic cables, to digital wireless communications.

SUMMARY OF THE INVENTION

Aspects of the present invention provide a novel method and apparatus to create a split-ring resonator and related structures that operate at and interact with optical frequencies making a new approach to photonic metamaterials and the associated applications possible. To achieve this and other properties, aspects of the present invention create a split-ring resonator which employs an ionized or charged gas or beam, a plasma, or any similar type of a particle-level conductor confined in a small etching space or formed space of a substrate.

According to one aspect of the present invention, a split-ring resonator includes a substrate with inner and outer trenches, cavities, or channels formed or etched into the substrate, with a gap region between the inner and outer trenches, cavities, or channels. The inner trench includes a split, and the outer trench, cavity, or channel formed or etched into the substrate also has a split located at the opposite end of the split in the inner trench. A second substrate with inner and outer trenches, cavities, or channels formed or etched into the second substrate corresponding to the inner and outer trenches, cavities, or channels etched into the first substrate, with a gap region in the second substrate between the inner and outer trenches, cavities, or channels corresponding to the gap region between the inner and outer trenches, cavities, or channels in the first substrate. The inner trench includes a split, and the outer trench, cavity, or channel formed or etched into the substrate also has a split located at the opposite end of the split in the inner trench. The second substrate is attached above the first substrate, forming a tight seal that encloses the inner and outer trenches, cavities, or channels. An additional tunnel, cavity, or channel is formed or etched onto the first substrate that connects with the outer trench, cavity, or channel, and which provides a tunnel or channel for injecting and/or expelling gases or plasmas. An additional tunnel, cavity, or channel is formed or etched onto the second substrate that connects with the inner trench, cavity, or channel, and which provides a tunnel or channel for injecting and/or expelling gases or plasmas. The gas- or plasma-filled trenches, cavities, or channels form the split-ring resonator structure.

According to an aspect of the present invention, a split-ring resonator includes a first substrate and a second substrate, an outer and inner trench or cavity formed or etched into the first substrate, the outer and inner trenches or cavities including a split, an outer and inner trench or cavity formed or etched into the second substrate corresponding to the outer and inner trenches or cavities in the first substrate, the outer and inner trenches or cavities in the second substrate each including another split disposed at an opposite end of the splits in each of the outer and inner trenches or cavities in the first substrate, the second substrate to attach to the first substrate and form a tight seal, and a conductive tunnel or channel formed or etched onto the first substrate and connected to the outer trench or cavity, the conductive tunnel or channel comprising an opening at an end of a surface of the first substrate configured to receive a gas and/or plasma that is or will be electrically conductive, a conductive tunnel or channel formed or etched onto the second substrate and connected to the inner trench or cavity and the conductive tunnel or channel comprising an opening at an end of a surface of the second substrate configured to receive a gas and/or plasma that is or will be electrically conductive, wherein the gas and/or plasma is emitted into the openings to fill the inner trench or cavity and the outer trench or cavity and form a split-ring resonator.

According to an aspect, the inner trench and the outer trench each include substantially circular shapes and the splits correspond to portions of the substantially circular shapes which are formed or etched into the first substrate and the second substrate.

According to an aspect, the inner trench or cavity has a radius of 30 nm or less.

According to an aspect, the inner trench and the outer trench are formed using scanning tunneling microscopy.

According to an aspect, the inner trench and the outer trench are formed using atomic force microscopy.

According to an aspect, the conductive tunnels or channels are formed using scanning tunneling microscopy.

According to an aspect, the conductive tunnels or channels are formed using atomic force microscopy.

According to an aspect, the gas and/or plasma is ionized before being emitted into the conductive tunnels or channels.

According to an aspect, the gas and/or plasma is ionized after being emitted into the conductive tunnels or channels.

According to an aspect, the first substrate and the second substrate are each formed of a fiberglass circuit board.

According to an aspect, the opening is connected to another opening in another split-ring, resonator according to an aspect of the present invention to form a plurality of the split-ring resonators.

According to another aspect of the present invention, a method to form a split-ring resonator includes etching an outer trench or cavity into a first substrate, the outer trench or cavity including a split which prevents one end of the outer trench or cavity from connecting to an opposite end of the outer trench or cavity, etching an inner trench or cavity into the first substrate inside the outer trench or cavity, the inner trench or cavity including another split disposed at an opposite end of the split in the outer trench or cavity, attaching a second substrate to the first substrate to form a tight seal, etching a conductive tunnel or channel onto the first substrate, the conductive tunnel or channel in the first substrate being connected to the outer trench or cavity, the conductive tunnel or channel including an opening at an end of a surface of the first substrate to receive a gas and/or plasma configured to be electrically conductive, and etching a conductive tunnel or channel onto the second substrate, the conductive tunnel or channel in the second substrate being connected to the inner trench or cavity, the conductive tunnel or channel including an opening at an end of a surface of the second substrate to receive a gas and/or plasma configured to be electrically conductive, wherein the gas and/or plasma is emitted into the openings to fill the inner trench or cavity and the outer trench or cavity and form a split-ring resonator.

According to another aspect, the inner trench and the outer trench each include substantially circular shapes and the splits correspond to portions of the substantially circular shapes which are not formed or etched into the first substrate and the second substrate.

According to another aspect, the inner trench or cavity has a radius of 30 nm or less.

According to another aspect, the inner trench and the outer trench are formed using scanning tunneling microscopy.

According to another aspect, the inner trench and the outer trench are formed using atomic force microscopy.

According to another aspect, the conductive tunnels or channels are formed using scanning tunneling microscopy.

According to another aspect, the conductive tunnels or channels are formed using atomic force microscopy.

According to another aspect, the method further includes ionizing the gas and/or plasma before emitting the gas and/or plasma into the conductive tunnels or channels.

According to another aspect, the method further includes ionizing the gas and/or plasma after emitting the gas and/or plasma into the conductive tunnels or channels.

According to another aspect of the present invention, a transmitting device includes an energy source, a split-ring resonator unit including a plurality of split-ring resonators, wherein each of the split-ring resonators includes a substrate, an inner trench or cavity formed or etched into the substrate, the inner trench or cavity comprising a split, and the outer trench or cavity formed or etched into the substrate around the inner trench or cavity, the outer trench or cavity comprising another split disposed at an opposite end of the split in the inner trench or cavity, wherein the inner trench and the outer trench are configured to receive an electrically conductive gas and/or plasma to form the split-ring resonator, and an ionized gas or plasma unit to transmit the ionized gas or plasma into the split-ring resonators in the split-ring resonator unit, wherein the energy source transmits light through the split-ring resonator unit, and the split-ring resonator unit is configured so that the light passing through is refracted according to a negative refractive index.

BRIEF DESCRIPTION OF THE DRAWINGS

These and other objects, features and advantages of aspects of the present invention will become apparent from the following detailed description of illustrative embodiments thereof, which is to be read in connection with the accompanying drawings, in which:

FIG. 3 depicts a top view of a split-ring resonator according to an embodiment of the present invention, before an ionized gas procedure;

FIG. 4 depicts a side view of the split-ring resonator shown in FIG. 3;

FIG. 8 depicts a representative illustration of entanglement, as employed according to a second embodiment of the present invention;

FIG. 9 depicts a method of controlling transmission through the air using an ion beam (point to point, line of sight) as well as a beam splitter to create an ion beam grid (point to multiple points), according to a second embodiment of the present invention.

DETAILED DESCRIPTION OF THE EMBODIMENTS

A basic concept of aspects of the present invention is to employ ionized or charged gas, beam, or plasma, or any similar type of a particle-level nonmagnetic conductor in place of conventional metallic rings, into a very finely etched or formed space of a substrate to achieve a split-ring resonator (SRR) with a diameter substantially smaller than SRRs of the related art. In doing so, the SRR according to aspects of the present invention achieves a myriad of benefits not achieved by conventional SRRs, such as the manipulation of visible light and even higher frequency radiation. The SRR according to aspects of the present invention can be used to wirelessly transmit energy, encoded data, communication signals, and many other types of radiation in advantageous ways.

Figure 1:
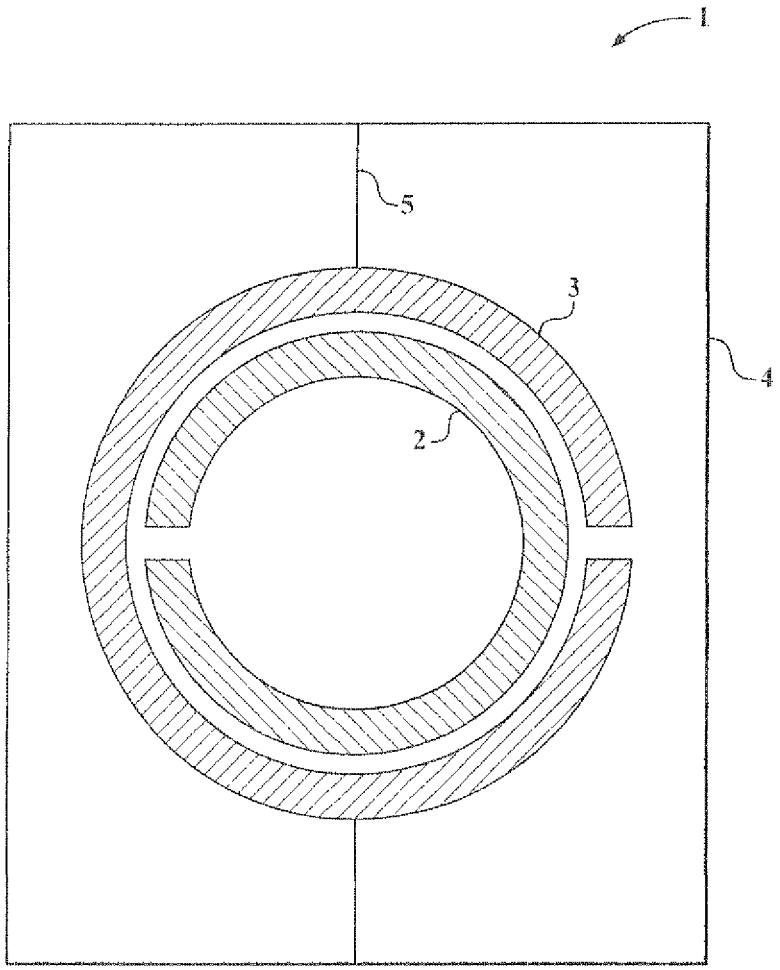
FIG. 1 Prior Art
FIG. 1 depicts a conventional split-ring resonator according to the related art.
Figure 2:
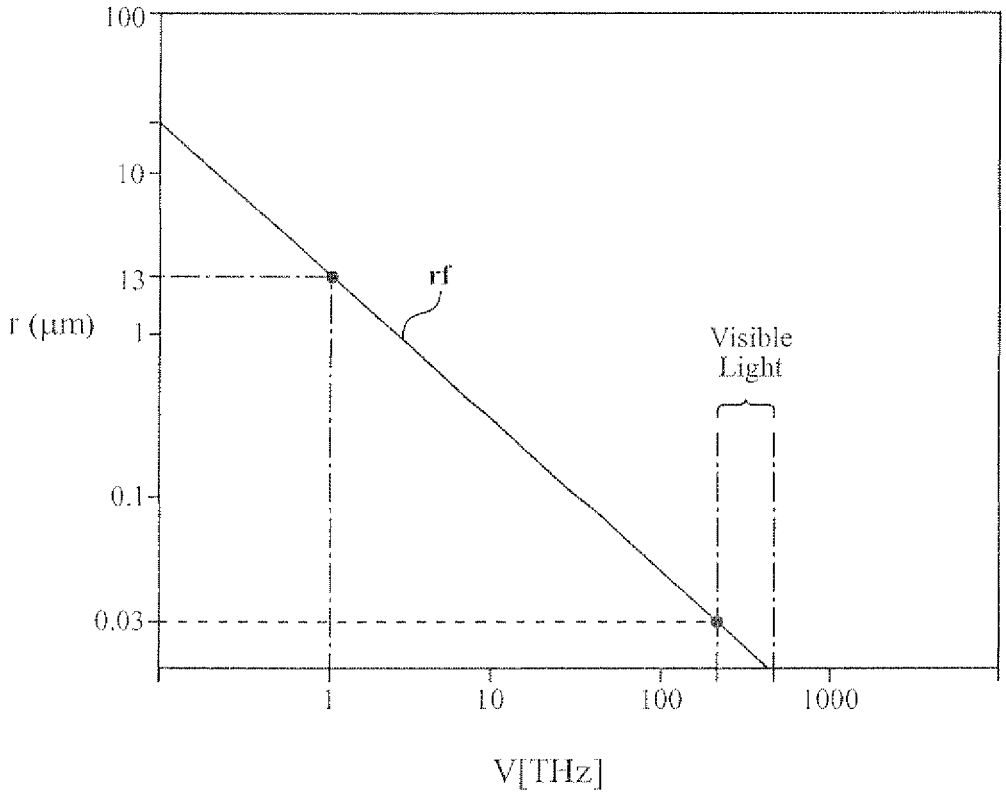
FIG. 2 depicts the relationship between the inner radii of a split ring resonator and the frequency of radiation to achieve a resonant frequency.

FIG. 2 depicts the relationship between the inner radii of a SRR and the frequency of radiation to achieve a resonant frequency rf. In FIG. 2, the vertical column on the left-hand side of FIG. 2 corresponds to the inner radii r of a SRR, measured in units of micrometers (μm). The horizontal column corresponds to a frequency v of incoming radiation transmitted to the SRR, measured in units of trillions of Hertz (1 trillion Hertz=1 THz=$1\times10^{12}$ Hz). The diagonal resonant frequency rf line correlates, for a given incoming radiation with a frequency v, the necessary inner radii r of the SRR to achieve the resonant frequency which enables a negative refractive index.

For example, as shown in FIG. 2, if an incoming radiation has a frequency v of 1 THz, the SRR should have an inner radii r of approximately 13 μm or less to achieve the resonant frequency. For visible light, which has a frequency v ranging from about 430 trillion Hz (430 THz) to about 750 trillion Hz (750 THz), and a corresponding wavelength range of about 380 nm 780 nm, the SRR should have an inner radii r of approximately 0.3-0.4 μm. As the frequency v of incoming radiation increases, the inner radii r of the SRR required to achieve the resonant frequency correspondingly decreases.

FIG. 3 depicts a top view of an SRR according to an embodiment of the present invention, before an ionized or charged gas or plasma procedure. As shown in FIG. 3, the SRR 10 according to an embodiment includes a bottom substrate 14 and a top substrate 16, which may be formed of various materials, including, but not limited to, a fiberglass circuit board, a metal such as gold, a plastic, glass, porcelain, graphite, graphene, etc. An inner circular trench 12 and an outer circular trench 13 are formed or etched onto the bottom substrate 14. An inner circular trench 12*a* and an outer circular trench 13*a* are formed or etched onto the top substrate 16. The inner circular trench 12 and inner circular trench 12*a* are formed in a substantially circular shape, with a split at one point of the trench 12 and trench 12*a*. The split may be formed, for example, by not etching on this designated portion, by inserting an object into the etching, or by various other ways known to those of skill in the art. The outer circular trench 13 and outer circular trench 13*a* are also formed in a substantially circular shape and are disposed outside of the inner circular trench 12 and inner circular trench 12*a* in a concentric fashion. The outer circular trench 13 and outer circular trench 13*a* are formed to have a split at approximately 180° from the split in the inner circular trench 12 and inner circular trench 12*a*. Thus, according to an aspect of the present invention, the inner circular trench 12, inner circular trench 12*a*, outer circular trench 13, and outer circular trench 13*a* are formed to have a substantially circular SRR shape. However, it is understood that the SRR according to other aspects of the present invention is not limited to having a substantially circular shape, and that the inner and outer circular trenches may instead have numerous other shapes known to those of skill in the art, such as square shapes, etc.

A conductive tunnel 15 (also referred to as a channel) is also formed or etched onto the bottom substrate 14 and is connected to the outer circular trench 13. The conductive tunnel 15 includes an opening 18*a* at the end of a surface of the substrate 14, which is used to receive gas that is ionized or charged either before or after introduction into the trench or conductive tunnel 15 and to expel such gas out of the conductive tunnel 15. A conductive tunnel 15*a* is also formed or etched onto the top substrate 16 and is connected to the inner circular trench 12. The conductive tunnel 15*a* includes an opening 18*b* at the end of a surface of the substrate 16, which is used to receive gas that is ionized or charged either before or after introduction into the trench or conductive tunnel and to expel such gas out of the conductive tunnel 15*a*. According to an aspect, the conductive tunnel 15 and conductive tunnel 15*a* are designed to be substantially straight. However, it is understood that the conductive tunnel 15 and conductive tunnel 15*a* are not limited to this, and may instead be formed in numerous other directions, such as curved directions, geometric shapes, etc. It is further understood that the process of "etching" or "forming" the trenches 12, 12*a*, 13, and 13*a* and conductive tunnels 15 and 15*a* is not intended to be limited to the conventional etching/engraving/cutting/tunneling/drilling processes, but may include any method to create a channel or cavity no matter how it is created in the substrate (e.g., the substrate could be created with the channels and cavities through a molding process, etc.). It is further understood that the SRR 10 according to other aspects of the present invention is not limited to having the conductive tunnel 15 connect to the outer circular trench 13 and the conductive tunnel 15*a* connect to the inner circular trench 12, and that this configuration may be reversed (i.e., conductive tunnel 15 connects to the inner circular trench 12 and conductive tunnel 15*a* connects to the outer circular trench 13). It is further understood that the SRR 10 is not limited to having one conductive tunnel connect to each of the inner and outer rings, and may instead employ any combination and number of conductive tunnels to connect to the inner and outer rings.

The SRR 10 also includes a top substrate 16 which is designed to attach securely above the bottom substrate 14 to form a tight seal. The top substrate 16 may be formed out of the same material as the bottom substrate, or may be formed out of different materials. The bottom substrate 14 includes a series of bottom fasteners 17 to connect to a corresponding group of top fasteners 18 included on the top substrate 16. By use of the bottom fasteners 17 and top fasteners 18, the bottom substrate 14 and top substrate 16 can be firmly sealed together to seal in ionized gas which is distributed into the inner circular trench 12, inner circular trench 12*a*, outer circular trench 13, outer circular trench 13*a*, conductive tunnel 15, and conductive tunnel 15*a*. According to an aspect of the present invention, the bottom substrate 14 includes four bottom fasteners 14 corresponding to four top fasteners 18, although it is understood that any number of fasteners may be used in any number of combinations to connect the top and bottom substrates 14 and 16. Furthermore, the fasteners may be formed of any number of different materials known to those of skill in the art, such as adhesives, magnets, etc.

FIG. 4 depicts a side view of the split-ring resonator shown in FIG. 3. As shown in FIG. 4, the inner circular trench 12 and the outer circular trench 13 are etched into a surface of the bottom substrate 14, and the inner circular trench 12*a* and the outer circular trench 13*a* are etched into a surface of the top substrate 16. When the bottom substrate 14 and the top substrate 16 are firmly sealed together, the inner circular trenches 12 and 12*a* form a cylindrical ring shape having a diameter d and a height h. The diameter d can be formed to be sufficiently small to create an SRR for visible light and other high frequency radiation. According to an aspect of the present invention, the diameter d can be formed to have a diameter of approximately 60 nm, and thus an inner radii r of approximately 30 nm. However, it is understood that the inner radii r is not limited to being 30 nm, and may instead be longer or shorter according to other aspects of the present invention.

To achieve a sufficiently small inner radii r, the inner circular trench 12, outer circular trench 13, and conductive tunnel 15 may be etched or formed into the bottom substrate 14 using a number of different techniques, including different types of microscopy techniques. Moreover, to achieve a sufficiently small inner radii r, the inner circular trench 12*a*, outer circular trench 13*a*, and conductive tunnel 15*a* may be etched or formed into the top substrate 16 using a number of different techniques, including different types of microscopy techniques. For example, a scanning tunneling microscope (STM) may be used to perform scanning tunneling microscopy, which includes applying voltage pulses to the bottom substrate 14 and the top substrate 16 which can result in an inner radii of as low as 2 nm. By using voltage pulses from an STM to form the trenches 12, 12*a*, 13, and 13*a* and conductive tunnels 15 and 15*a*, the SRR according to aspects of the present invention can be formed with a much smaller radii than conventional SRR. The STM voltage pulse process may be used when the bottom substrate 14 and/or the top substrate 16 is gold, graphite, graphene, or any other number of metal or non-metal materials.

Alternatively, atomic force microscopy (AFM), also known as scanning force microscopy (SFM), may be used to etch or form the trenches 12 and 13 and conductive tunnel 15 into the bottom substrate 14 and to etch or form the trenches 12*a* and 13*a* and conductive tunnel 15*a* into the top substrate 16. AFM is a technique where an atomic force microscope including a cantilever with a sharp nanoscale tip (probe) is used to scan the surface of a substrate. AFM can also achieve extremely small etchings, on the order of 6 nm or less. Also, other types of nano level microscopy known to those of skill in the art may be used to etch or form the trenches 12 and 13 and conductive tunnel 15 on the bottom substrate 14 and to etch or form the trenches 12*a* and 13*a* and conductive tunnel 15*a* on the top substrate 16.

After forming the trenches 12, 12*a*, 13, and 13*a* and conductive tunnels 15 and 15*a*, the bottom substrate 14 is attached to the top substrate 16 using the bottom fasteners 17 and the top fasteners 18 and an electrically conductive gas, such as an ionized gas, plasma, ion beam, electrically conductive plasma, etc., is emitted into the trenches 12, 12*a*, 13, and 13*a* and conductive tunnels 15 and 15*a*. It would also be possible to inject a neutral gas and then to ionize the gas after injection into the trenches 12, 12*a*, 13, and 13*a* and conductive tunnels 15 and 15*a*. It is further noted that although the following description refers to an ionized gas being present in the trenches 12, 12*a*, 13, and 13*a* and conductive tunnels 15 and 15*a*, it is understood by those skilled in the art that various other types of electrically conductive media may alternatively be employed, including plasma, ion beam, electrically conductive plasma, etc., according to other aspects of the present invention. According to an aspect of the present invention, ionized air, which is generally a good conductor of electricity, is emitted into the trenches 12, 12*a*, 13, and 13*a* and conductive tunnels 15 and 15*a*. However, it is understood that many other types of ionized gas may be used besides ionized air which may also conduct electrical current. Furthermore, it is understood that the gas is not required to be ionized, and may instead be any sort of gas, plasma, etc., which is configured to be electrically conductive, i.e., has the potential to be electrically conductive.

Figure 5:
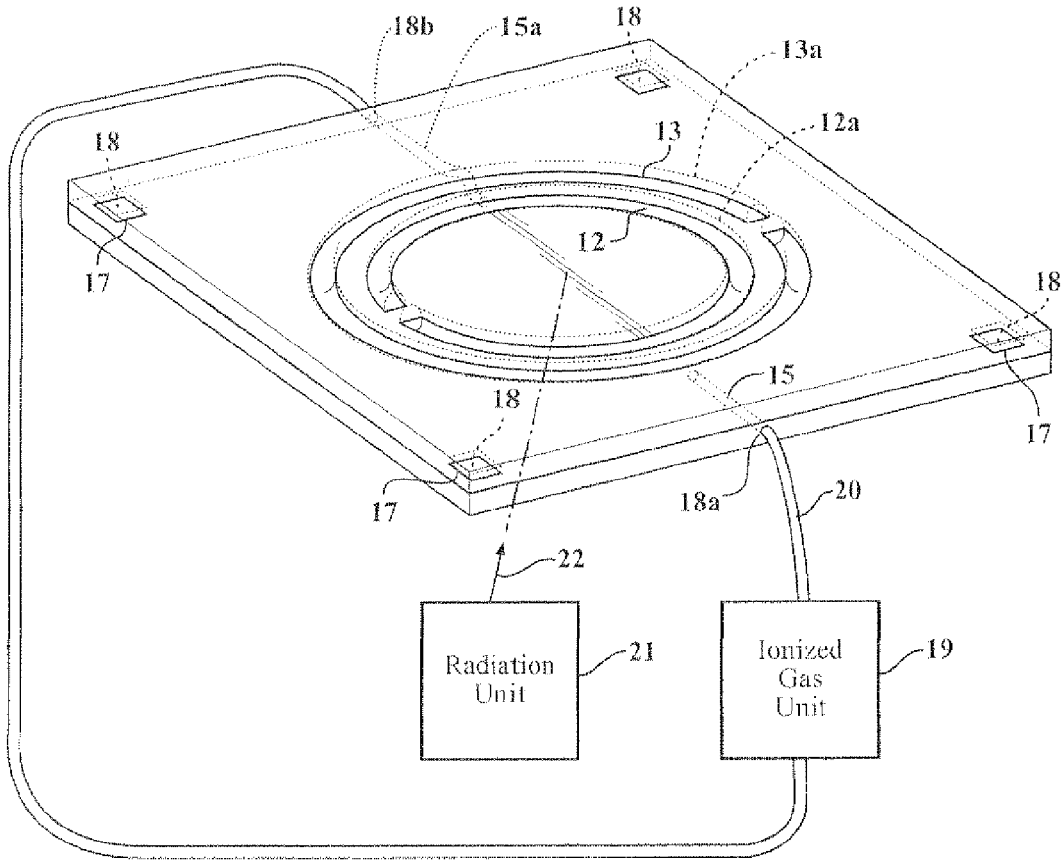
FIG. 5 depicts the top view of a split-ring resonator according to an embodiment of the present invention, after an ionized gas procedure.

FIG. 5 depicts a top view of the split-ring resonator according to an embodiment of the present invention, after an ionized gas or plasma procedure is performed. As shown in FIG. 5, the bottom substrate 14 is fastened to the top substrate 16 using the bottom fasteners 17 and the top fasteners 18 to achieve a sealed substrate. An ionized gas unit 19 is connected to an edge of the sealed substrate at the opening 18*a* and the opening 18*b*. The ionized gas or plasma unit 19 generates and fills the trenches 12, 12*a*, 13, and 13*a* and conductive tunnels 15 and 15*a* with ionized gas or plasma 20, for example, by pumping the ionized gas 20 into the opening 18*a* and the opening 18*b*. Before or after the ionized gas or plasma 20 is emitted into the trenches 12, 12*a*, 13, and 13*a* and conductive tunnels 15 and 15*a*, the openings 18*a* and 18*b* of the SRR 10 are preferably connected to similar openings in other SRR 10 to form a plurality of SRR 10. Any combination of adding together a plurality of the SRR 10 is possible. However, it is understood that aspects of the present invention are not limited to this, and may instead be used with only the single SRR 10.

Once the sealed substrate of the SRR 10 is filled with ionized gas or plasma 20 in the trenches 12, 12*a*, 13, and 13*a* and conductive tunnels 15 and 15*a*, the conductive tunnels 15 and 15*a* may be connected to another SRR, closed or tilled with a material, including the same material as the substrate 14 or substrate 16 or any material understood by those skilled in the art, which is able to, among other things, prevent the ionized gas or plasma 20 from exiting the trenches 12, 12*a*, 13, and 13*a*. After the sealed substrate of the SRR 10 is filled with ionized gas or plasma 20, a radiation unit 21 is used to emit radiation 22 at the SRR 10. According to an aspect of the present invention, the radiation 22 is visible light, which has a frequency v ranging from about 430 trillion Hz (430 THz) to about 750 trillion Hz (750 THz), and a corresponding wavelength range of about 380 nm 780 nm. Accordingly, the SRR 10 is designed so that the inner radii r of the inner circular trench 12 and 12*a* is approximately 0.3 μm, to successfully achieve the resonant frequency (see FIG. 2). When the radiation 22 strikes the SRR 10, the SRR 10 generates a radiation with resonant frequency 22' which may be manipulated in various ways. For example, the radiation 22' may be controlled to be aimed in a certain direction, as desired by the user. Since it is well known that E=hf (where F is energy, h is plank's constant, and f is frequency), as the frequency of the radiation 22 is increased, the corresponding energy of the radiation 22 is also increased. Also, the SRR 10 may be used to achieve a negative index of refraction for the incoming radiation 22, which has applications in creating higher diffraction limits for optical technology, as well as other applications. Numerous other benefits may also be achieved by using the SRR 10 according to aspects of the present invention.

Figure 6:
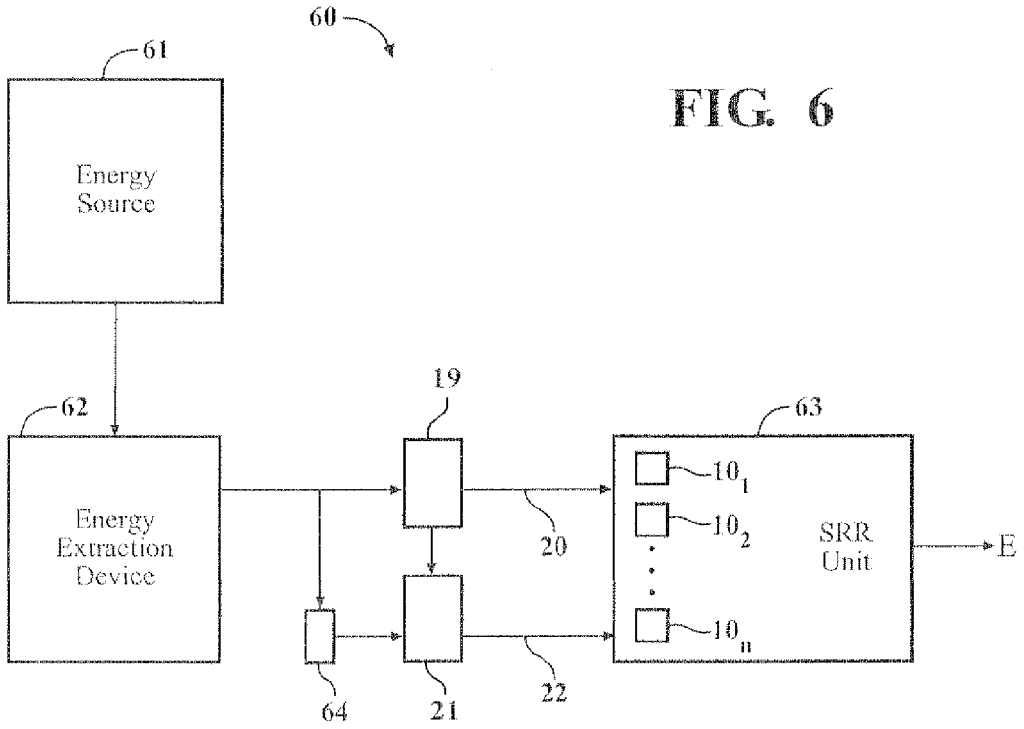
FIG. 6 depicts a transmitting device according to a second embodiment of the present invention.

FIG. 6 depicts a transmitting device according to a second embodiment of the present invention. As shown in FIG. 6, the transmitting device 60 includes an energy source 61, an energy extraction device 62, and a SRR unit 63 which includes n number of the SRR 10 described above (where n is greater than 1), as well as the ionized gas or plasma unit 19, the radiation unit 21, and a transmission controller 64 to control operations of the overall transmitter 60.

The energy source 61 generates energy using any number of techniques known in the art. According to an aspect of the present invention, almost any electric power source suffices to generate energy, and one skilled in the art would understand how to generate energy in numerous different ways. For example, energy could be generated by battery, by electrical source, by fossil fuel (e.g., oil or gas), by wind, water, nuclear power (such as fusion), etc.

According to another aspect, either neutral-beam injection or radio frequency heating (or both) may be used as plasma heating methods to generate energy. Also, it is understood by those skilled in the art that many different ways to generate energy are known and may be used in accordance with aspects of the present invention.

Once energy is generated by the energy source 61, the next step is that the energy is extracted using the energy extraction device 62. It is understood by those skilled in the art that the energy extraction device may extract energy from the energy source 61 in any number of ways. For example, if the energy source 61 generates electrical energy using wind power, solar power, etc., the energy extraction device 62 converts this electrical energy into stored electrical energy by storing the electrical energy in batteries, etc. it is understood by those skilled in the art that many different ways to extract energy are known and may be used in accordance with aspects of the present invention. Furthermore, it is understood that the energy source 61 and energy extraction device 62 are not required to be separate devices, and may instead be combined.

Once energy is extracted and stored by the energy extraction device 62, the energy stored by the energy extraction device 62 is used to provide energy to the ionized gas unit 19, radiation unit 21, and transmission controller 64. The transmission controller 64 may be implemented as hardware, such as a computer, or may be implemented as software readable on a computer, such as a hard disk having a program stored thereon, a flash drive, other types of ROM and RAM, etc. The transmission controller 64 is used to control the overall operations of the transmitter device 60, including the SRR unit 63, to achieve the beneficial effects described above in the section describing the benefits of the SRR 10. The SRR unit 63 transmits energy E in the form of radiation. The frequencies at which the transmitted energy E is transmitted can be adjusted according to various factors known to those skilled in the art.

Also, according to another aspect of the present invention, the transmission controller 64 can be used for quantum entanglement. FIG. 8 depicts a representative illustration of entanglement, as employed according to a second embodiment of the present invention. In FIG. 8, which depicts a known example of entanglement, two photons (light particles) are engaged using oscillating electric fields, 4 ions of beryllium, two cesium clouds, and a bean of polarized LASER light. Each cesium atom acts as a magnet. The magnetic field tilts oscillating electric fields through the first two clouds 1(*a*) and 1(*b*). An encoded message in a second LASER beam is transmitted through the first entangled cloud and a new second cloud 3 garbles the message. The clouds are entangled. A recipient with an identical LASER beam transmits the identical LASER beam through the entangled cloud and achieves a new cloud 4. The message transmitted at cloud 1 reappears at cloud 4.

Generally, it is known that entanglement can be used for communication and/or data transmission purposes, such as, for example, encrypting messages and then transmitting the encrypted message using the SRR unit 63. Quantum commercial devices are sold which sometimes employ entangled light. Thus, it is within the scope of various embodiments of the invention to use the SRR unit 63 in combination with entangled light for various purposes, such as, for example, encrypting messages.

According to an aspect of the present invention, entanglement can also be used for encryption for selective purposes, although it is understood that encryption is not required and may not even be relevant for certain purposes. Furthermore, it is understood that the transmission controller 64 can encrypt any messages transmitted by the transmitter 60 using other encryption methods, such as any encoding method known to those skilled in the art.

Figure 7:
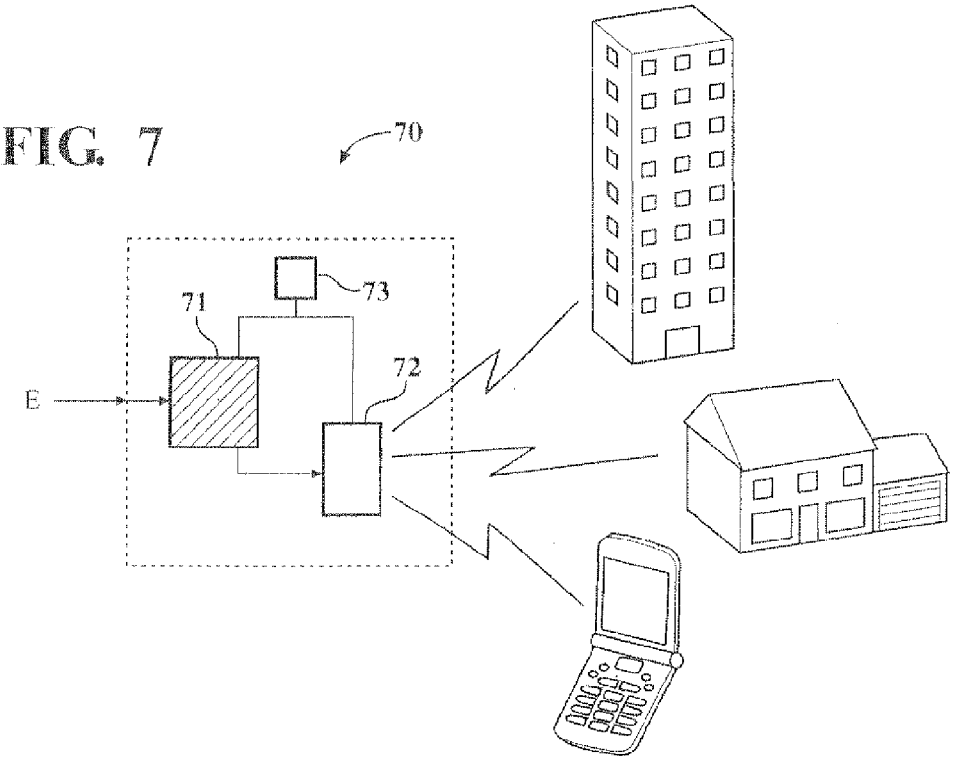
FIG. 7 depicts a receiving device according to a second embodiment of the present invention.

Once the electric signal. E is transmitted from the transmitter 60 shown in FIG. 6, the energy is then received at a reception point. FIG. 7 depicts a receiving device (reception point) according to a second embodiment of the present invention. As shown in FIG. 7, the receiving device 70 includes a reception grid 71, a link 72, and a reception controller 73. The reception grid 71 is a grid configured to receive radiation transmitted by the transmitting device 60 (FIG. 6) and convert the received radiation into electrical energy. The reception grid 71 may vary in size depending on the application, and may be relatively large (e.g., a typical office conference room, a football field size or larger), or relatively small (e.g., a TV screen size). For satellite to ground transmission, an ionic reception grid of perpendicular ion signal paths approximately 1,500 feet above land could be generated using beam splitters so that electrical signals from satellite can be directed to a particular quadrant on the grid 71 through attraction and/or entanglement. From the quadrant above the ultimate reception point, the electric signal is delivered. For shorter transmission distances, such as from a tower antenna to a receiver nearby, or for indoor/internal applications, a single ion signal path may be used.

Once the reception grid 71 converts the received energy into electrical energy, the link 72 supplies the electrical energy to any application desired by the user. For example, the link 72 may supply the electrical energy to relatively large structures, such as a building or a housing unit, or relatively small structures such as a mobile phone. The link 72 may be comprised of wires, cables, voltage dividers, transistors, and any other device known to those of skill in the art to transmit, repeat, and/or store electrical energy.

The reception controller 73 controls the overall operations of the receiving device 70. The reception controller 73 may also be used to decrypt signals encrypted by the transmitting controller 64 (FIG. 6), using the quantum entanglement method described above or other decryption methods depending on the method used by the transmitting controller 64. The reception controller 73 is also used to control an allocation of the converted electrical energy to the appropriate end points, e.g., a building, a house, a mobile phone, etc. Similar to the transmission controller 64, the reception controller 73 may be implemented as hardware or software.

FIG. 9 depicts a method of controlling transmission through the air using all ion beam (point to point, line of sight) as well as a beam splitter to create an ion beam grid (point to multiple points), according to a second embodiment of the present invention. As shown in FIG. 9, a grid 90 according to other aspects of the present invention is much bigger than the reception grid 71 shown in FIG. 7. The grid 90 includes rows and columns. The grid 90 is disposed above a neighborhood, e.g., by towers, and wirelessly supplies energy to the various residencies and facilities in the neighborhood using the wireless energy transmission and reception device described above. The grid 90 has a constant stream of electricity flowing through its structure.

In the example shown in FIG. 9, the house 94 owns access to grid row-column spot B4. The house uses the reception device 93, which may be configured in substantially the same fashion as the reception device 70 shown in FIG. 7. Using the entanglement principles described above, the house 94 can direct requests for energy to the appropriate spot on the grid 94 and receive energy wirelessly from spot 84 in the grid 94. As a result, the house 94 wirelessly receives energy. Also, the house 94 may also wirelessly transmit energy/information using the same principles. As a result, telephone lines are no longer necessary.

Figure 10:
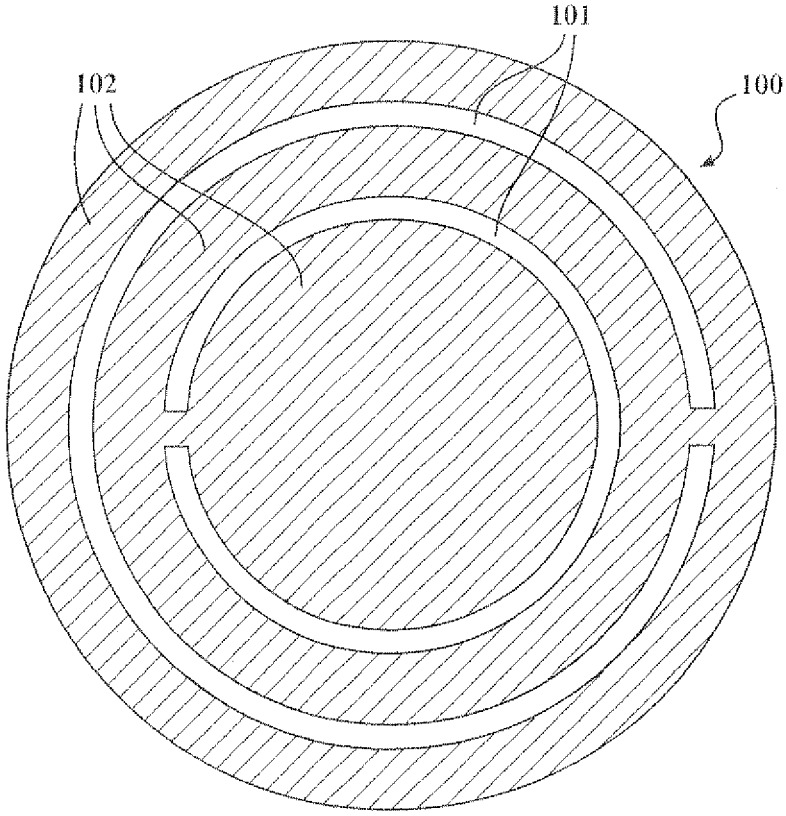
FIG. 10 depicts a top view of a lens used to form a split-ring resonator according to a third embodiment of the present invention.

Also, according to a third embodiment, the SRR can be formed using a charged particle beam or beams. FIG. 10 depicts a lens 100 which includes a translucent or transparent portion 101 in a geometric shape with a split and further includes an opaque portion 102. Lead or other material known to those skilled in the art may be used to cover or be attached to the lens 100 accordingly. According to an aspect of the third embodiment, a charged particle beam is generated by an infrared free-electron or similar LASER with the lens 100 depicted in FIG. 10 attached to the emission point of such LASER, thereby projecting a geometric shape with a split. Furthermore, a second charged particle beam is generated by an infrared free-electron or similar LASER with the lens 100 depicted in FIG. 10 attached to the emission point of such LASER projecting a second geometric shape in a concentric fashion to the first charged beam; with a split disposed approximately 180° from the split in the first charged beam and a gap between the two charged beams. Once the two charged beams are projected onto a substrate, a radiation unit, for example, the radiation unit 21 (FIG. 5), is used to emit radiation 22 at the SRR. The translucent or transparent portion 101 of the lens 100 can be formed to be extremely small, using, for example, techniques described above in connection with other embodiments, or other techniques known in the art.

Accordingly, the SRR according to aspects of the present invention achieves a myriad of benefits not achieved by conventional SRRs, such as the manipulation of visible light and even higher frequency radiation. The SRR according to aspects of the present invention can be used to wirelessly transmit energy, encoded data, and many other types of radiation in advantageous ways.

What is claimed is:

1. A split ring-resonator, comprising:

a substrate;

an inner trench or cavity formed into the substrate, the inner trench or cavity comprising a split; and an outer trench or cavity formed into the substrate around the inner trench or cavity, the outer trench or cavity comprising another split disposed at an opposite end of the split in the inner trench or cavity, wherein the inner trench or cavity and the outer trench or cavity are configured to receive an electrically conductive gas and/or plasma to form a split-ring resonator, and the inner trench or cavity has a radius of 40 nm or less.

2. The split-ring resonator according to claim 1, further comprising:

another substrate to attach to the substrate and form a tight seal;

a conductive tunnel or channel formed onto one of the substrates and connected to the outer trench or cavity, the conductive tunnel or channel comprising an opening to receive the conductive gas and/or plasma; and another conductive tunnel or channel formed onto the other substrate and connected to the inner trench or cavity, the other conductive tunnel or channel comprising another opening to receive the conductive gas and/or plasma.

3. The split-ring resonator according to claim 2, wherein the inner trench or cavity and the outer trench or cavity each comprise substantially circular shapes and the splits correspond to portions of the substantially circular shapes which are not formed into the substrates.

4. The split-ring resonator according to claim 2, wherein the inner trench or cavity has a radius of 30 nm or less.

5. The split-ring resonator according to claim 4, wherein the inner trench or cavity, the outer trench or cavity, and the conductive tunnels or channels are formed using scanning tunneling microscopy.

6. The split ring resonator according to claim 4, wherein the inner trench or cavity, the outer trench or cavity, and the conductive tunnels or channels are formed using atomic force microscopy.

7. The split-ring resonator according to claim 2, wherein the gas and/or plasma is ionized before being emitted into the conductive tunnel or channel.

8. The split-ring resonator according to claim 2, wherein the gas and/or plasma is ionized after being emitted into the conductive tunnel or channel.

9. The split-ring resonator according to claim 1, wherein the substrates are each formed from a fiberglass circuit board.

10. The split-ring resonator according to claim 2, wherein the opening is connected to another opening in another split-ring resonator according to claim 2 to form a plurality of the split-ring resonators.

11. A method to form a split-ring resonator, comprising:

forming an inner trench or cavity into a substrate, the inner trench or cavity comprising a split;

forming an outer trench or cavity into the substrate around the inner trench or cavity, the outer trench or cavity comprising another split disposed at an opposite end of the split in the inner trench or cavity; and emitting an electrically conductive gas and/or plasma into the inner trench or cavity and the outer trench or cavity to form a split-ring resonator, and the inner trench or cavity has a radius of 40 nm or less.

12. The method according to claim 11, further comprising:

attaching another substrate to the substrate to form a tight seal;

forming a conductive tunnel or channel onto one of the substrates such that the conductive tunnel is connected to the outer trench or cavity and comprises an opening to receive the electrically conductive gas and/or plasma; and forming another conductive tunnel or channel onto the other substrate such that the other conductive tunnel is connected to the inner trench or cavity and comprises another opening to receive the electrically conductive gas and/or plasma, wherein the emitting of the electrically conductive gas and/or plasma comprises emitting the electrically conductive gas and/or plasma into the opening and the other opening.

13. The method according to claim 12, wherein the inner trench or cavity and the outer trench or cavity each comprise substantially circular shapes and the splits correspond to portions of the substantially circular shapes which are not formed into the substrates.

14. The method according to claim 12, wherein the inner trench or cavity has a radius of 30 nm or less.

15. The method according to claim 14, wherein the inner trench or cavity, the outer trench or cavity, and the conductive tunnels or channels are formed using scanning tunneling microscopy.

16. The method according to claim 14, wherein the inner trench or cavity, the outer trench or cavity, and the conductive tunnels or channels are formed using atomic force microscopy.

17. A transmitting device, comprising:

an energy source;

a split-ring resonator unit comprising a plurality of split-ring resonators, wherein each of the split-ring resonators comprises:

a substrate, an inner trench or cavity formed into the substrate, the inner trench or cavity comprising a split, and an outer trench or cavity formed into the substrate around the inner trench or cavity, the outer trench or cavity comprising another split disposed at an opposite end of the split in the inner trench or cavity, wherein the inner trench or cavity and the outer trench or cavity are configured to receive an electrically conductive gas and/or plasma to form the split-ring resonator; and an ionized gas or plasma unit to transmit the ionized gas or plasma into the split-ring resonators in the split-ring resonator unit, wherein the energy source transmits light through the split-ring resonator unit, and the split-ring resonator unit is configured so that the light passing through is refracted according to a negative refractive index, and the inner trench or cavity has a radius of 40 nm or less.

18. The transmitting device of claim 17, wherein the inner trench or cavity and the outer trench or cavity of each of the split-ring resonators are formed using scanning tunneling microscopy.

19. The transmitting device of claim 17, wherein the inner trench or cavity and the outer trench or cavity of each of the split-ring resonators are formed using atomic force microscopy.

20. The transmitting device of claim 17, wherein the inner trench or cavity has a radius of 30 nm or less.

* * * * *